US005460292A

United States Patent [19]

Holman

[11] Patent Number: 5,460,292

[45] Date of Patent: Oct. 24, 1995

[54] AGRICULTURAL CONTAINER WITH CORNER STRUTS

[76] Inventor: Don Holman, 9073 Deadmans Hill, Cashmere, Wash. 98815

[21] Appl. No.: 245,443

[22] Filed: Aug. 17, 1994

Related U.S. Application Data

[63] Continuation-in-part of Ser. No. 89,686, Jul. 9, 1993.

[51] Int. Cl.[6] ..... B65D 1/44

[52] U.S. Cl. ..... 220/675; 220/673; 220/646; 206/512

[58] Field of Search ..... 220/675, 676, 220/673, 670, 669, 1.5, 608, DIG. 12, DIG. 14, 646, 650, 651, 645, 729; 206/512, 511, 509, 386, 599

[56] References Cited

U.S. PATENT DOCUMENTS

| | | | |
|---|---|---|---|
| 3,246,826 | 4/1966 | Clemens | 206/512 |
| 3,367,526 | 2/1968 | Schmied et al. | 220/646 |
| 3,917,108 | 11/1975 | Thurman | 220/66 |
| 4,613,045 | 9/1986 | Watson | 206/512 |
| 5,143,283 | 9/1992 | Lancaster | 220/651 |
| 5,180,064 | 1/1993 | Elvin-Jensen | 220/675 |

FOREIGN PATENT DOCUMENTS

| | | | |
|---|---|---|---|
| 0041307 | 12/1981 | European Pat. Off. | B65D 1/42 |
| 371565 | 6/1990 | European Pat. Off. | 220/675 |
| 0479073A2 | 9/1991 | European Pat. Off. | B65D 19/04 |
| 1240706 | 8/1960 | France | 206/512 |
| 1389232 | 1/1965 | France | 206/512 |
| 2005440 | 12/1969 | France | B65B 31/00 |
| 2255221 | 7/1975 | France | B65D 1/22 |
| 2514323 | 4/1983 | France | 206/512 |
| 404327129 | 11/1992 | Japan | 220/675 |
| 8800486 | 2/1988 | Netherlands | B65D 19/28 |
| 2076366 | 11/1981 | United Kingdom | 206/512 |

*Primary Examiner*—Stephen J. Castellano
*Attorney, Agent, or Firm*—Stratton Ballew

[57] ABSTRACT

A Plastic fruit bin having four vertical walls and a bottom joined to the walls. Two supporting elements extending along and attached to the bottom elements. An array of gas injection tubes disposed on the lower side of the bottom element and extending up the center of each of the vertical walls. The vertical walls are joined to each other at their sides by a triangular shaped column, each of said columns forming a corner of the bin, and the columns being stiffened internally with longitudinal ribs. A rectangular recess at the bottom of each corner, the depth of the recess rising to the level of the bottom element of the bin, the recess being partially closed by a triangular shelf having its apex at the inner corner of the rectangle, and being defined by two corners of the rectangle adjacent to the inner corner, with the edge of the shelf which extends between the two corners of the rectangle defining the lower end of a triangular passageway. A bottom closure cap having a triangular strut extending upwardly therefrom for almost the full height of the bin. The closure cap having vertical plates which contact the triangular shelf when the triangular shelf is inserted into the triangular passageway and the bottom closure cap fully closes the rectangular recess.

14 Claims, 13 Drawing Sheets

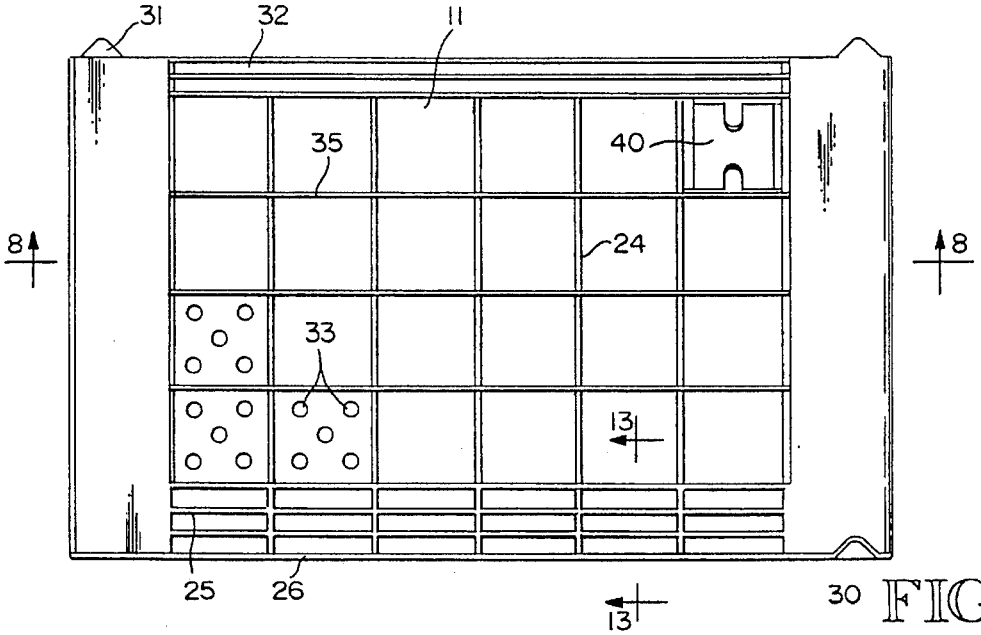
FIG. 3
FIG. 4
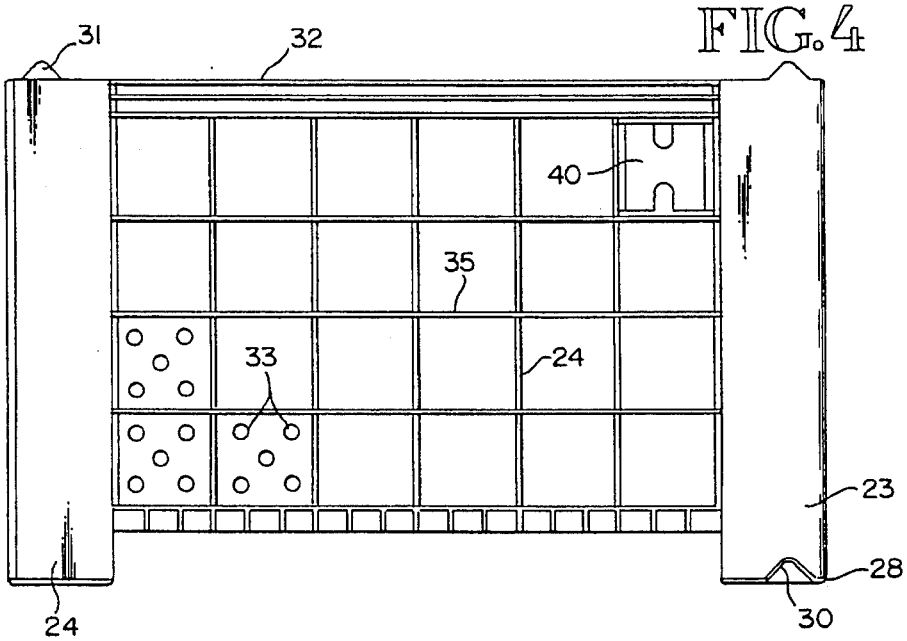
FIG. 13
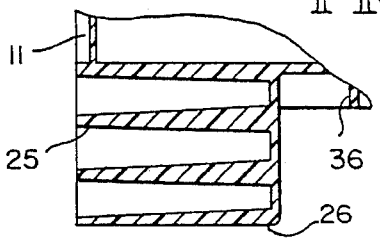
FIG. 14
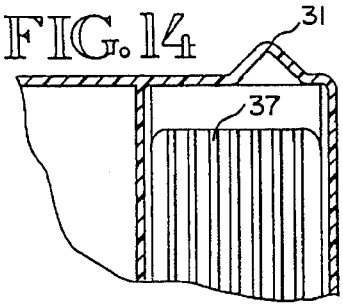

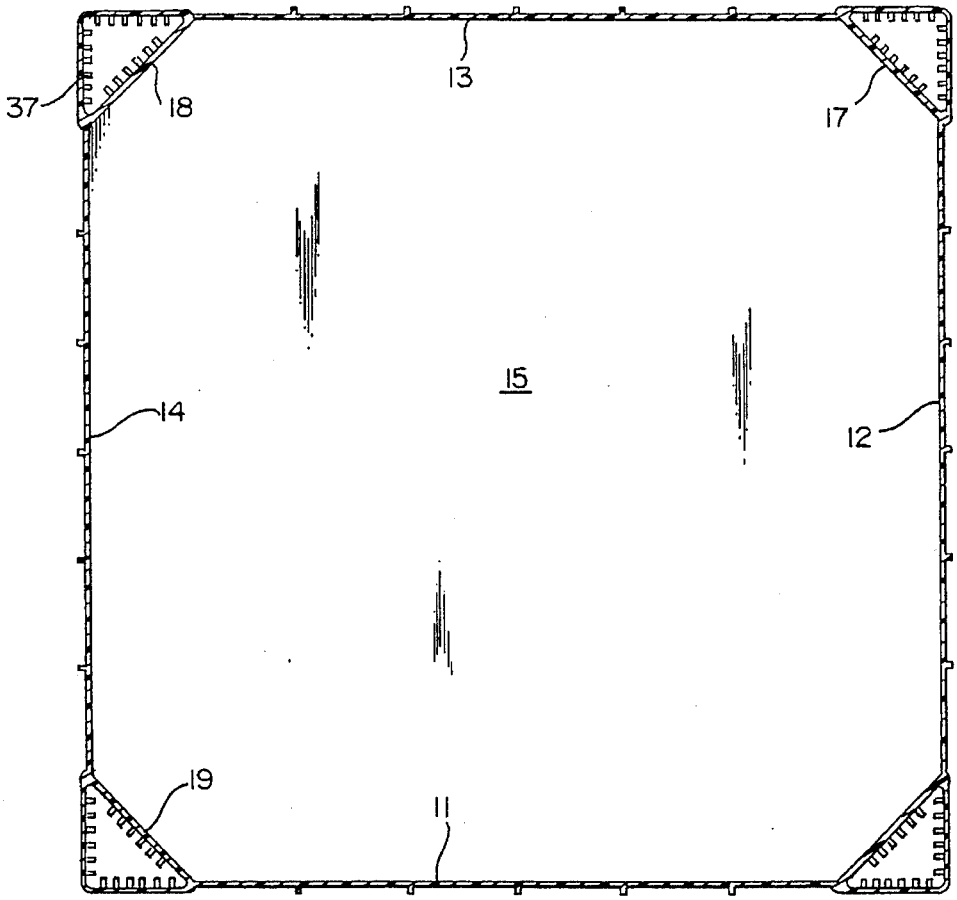
FIG. 8
FIG. 7
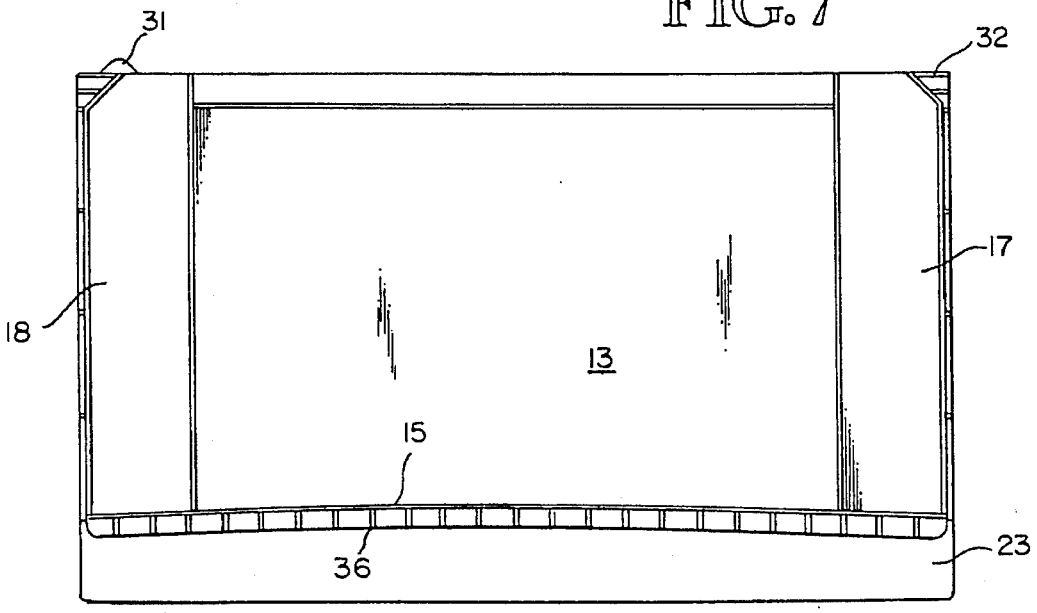

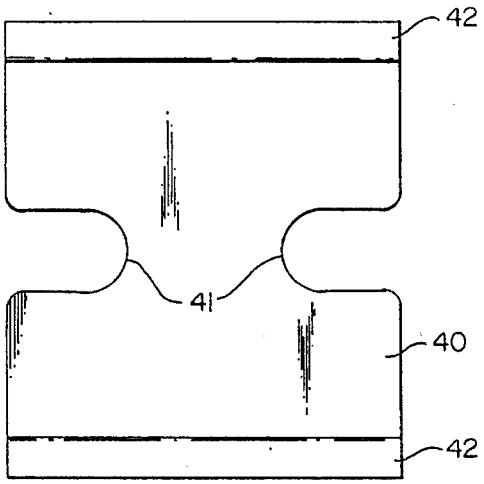
FIG. 16A
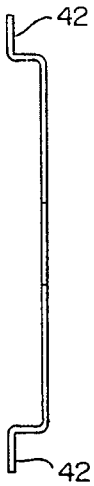
FIG. 16B
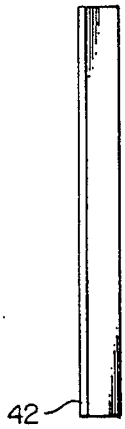
FIG. 16C
FIG. 17
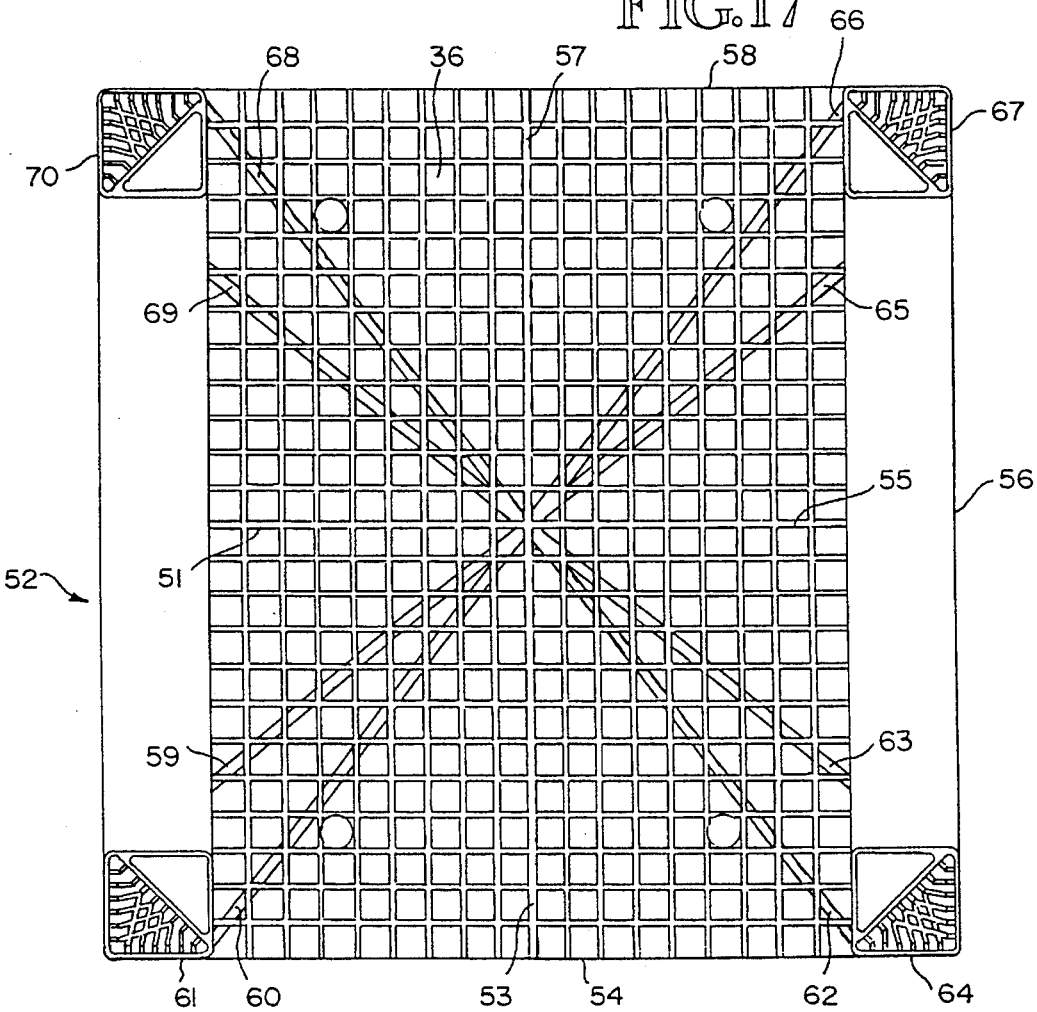

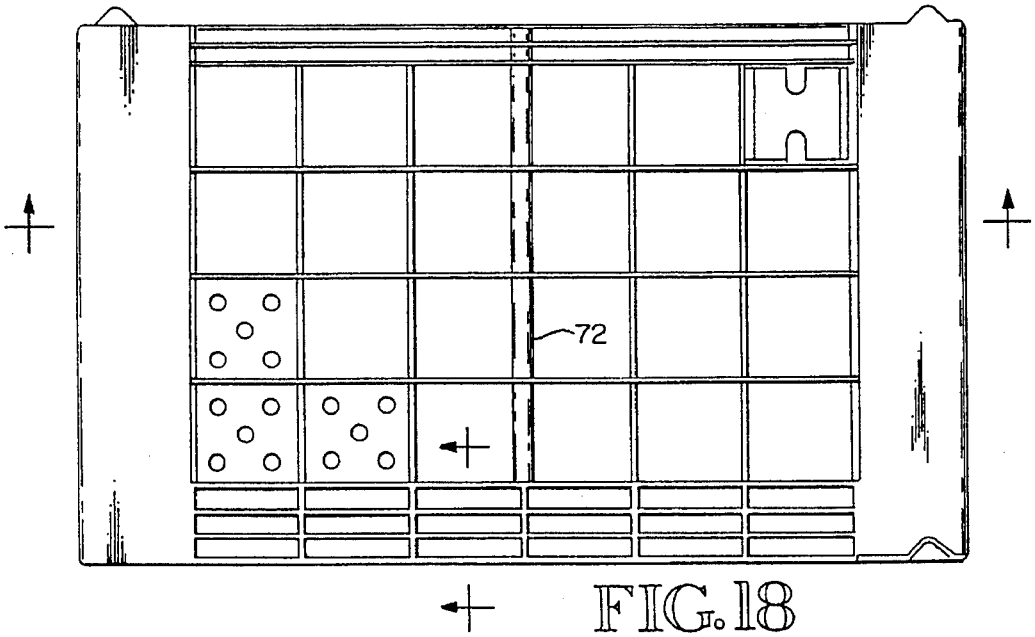
FIG. 18
FIG. 19
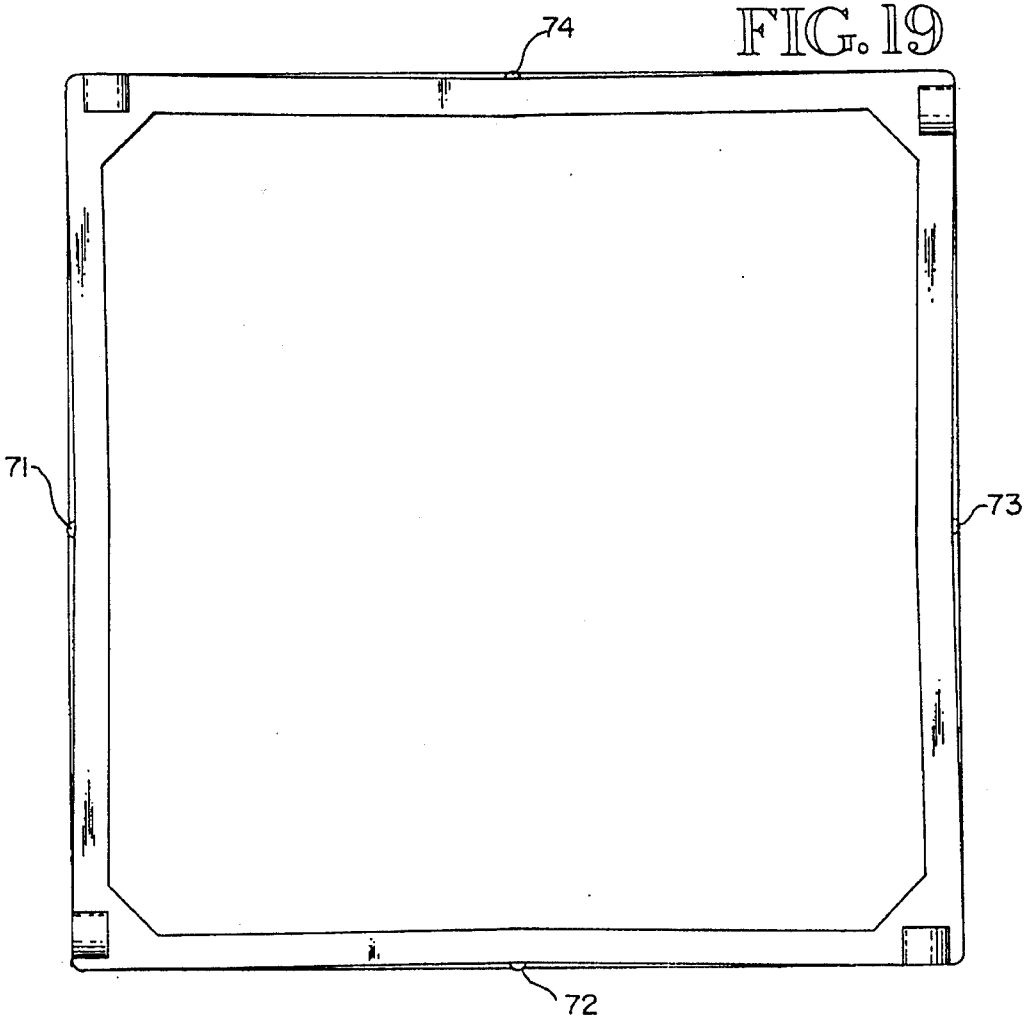

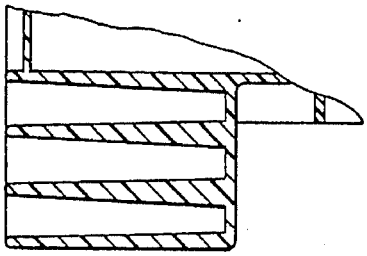
FIG. 20
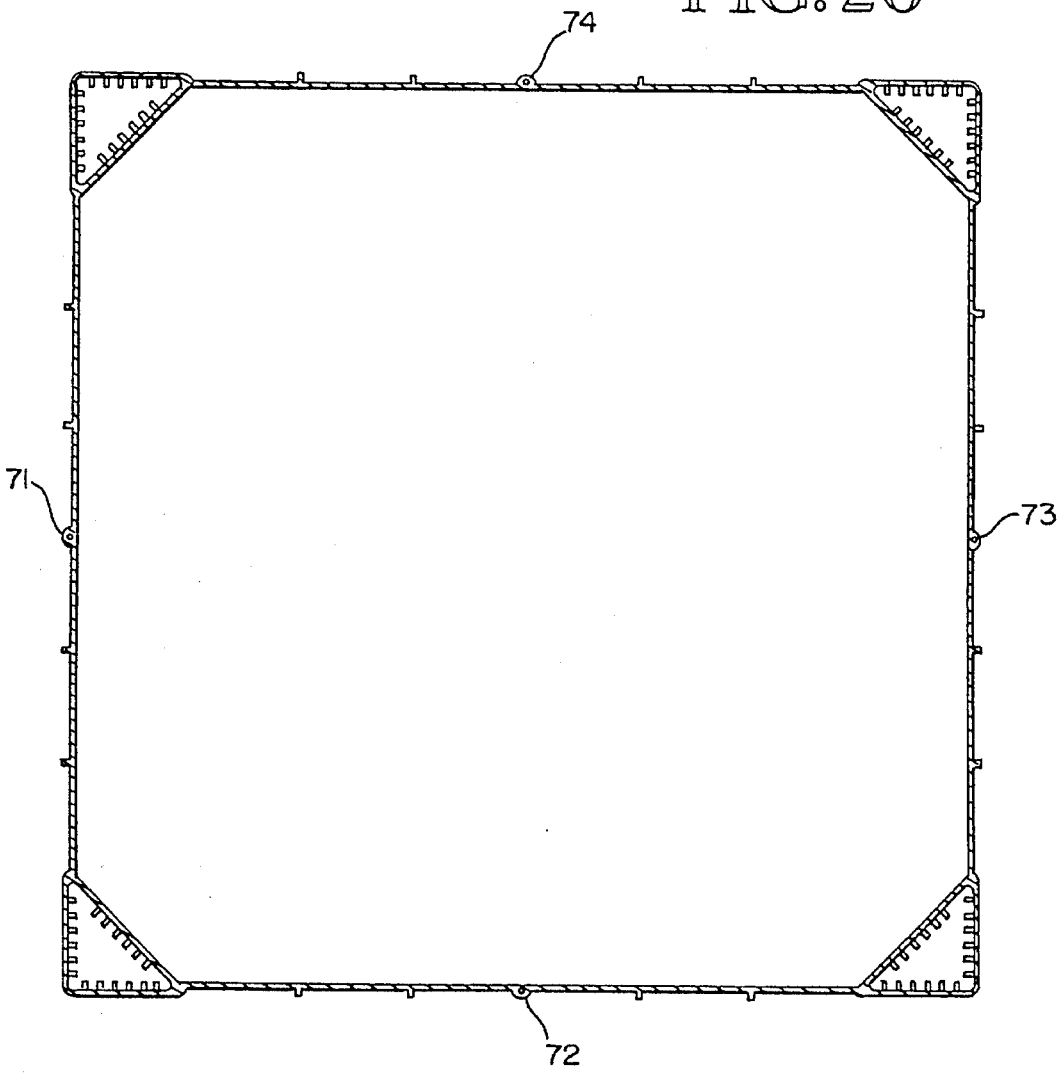

FIG. 23
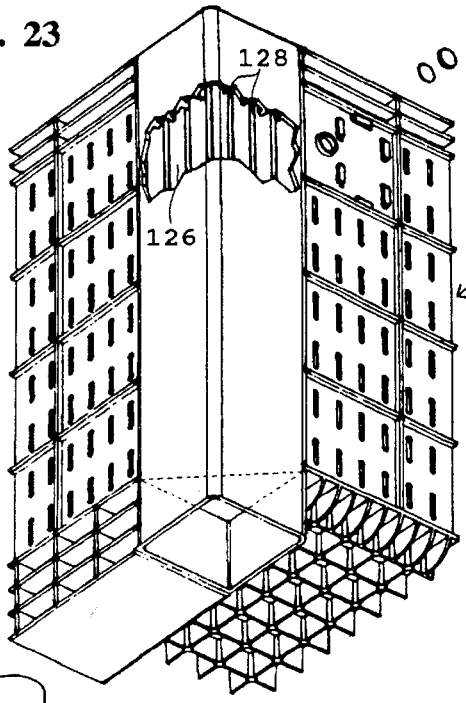
FIG. 26
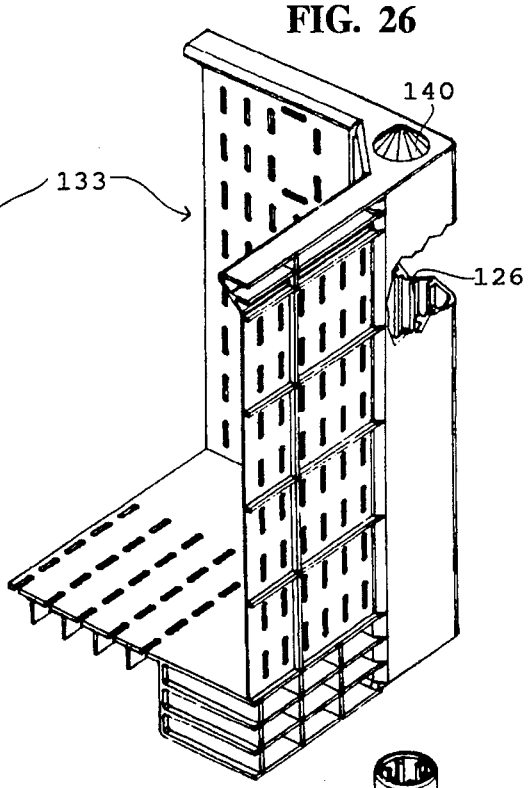
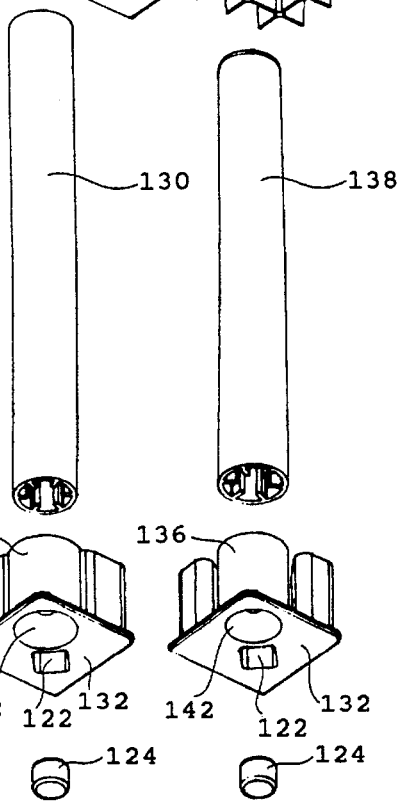
FIG. 24 FIG. 25
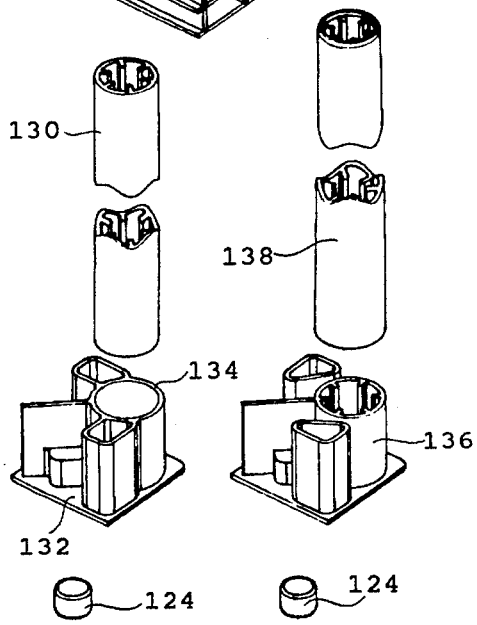
FIG. 27 FIG. 28

AGRICULTURAL CONTAINER WITH CORNER STRUTS

This application is a continuation-in-part of Ser. No. 08/089,686 filed on Jul. 9, 1993 and now pending.

BACKGROUND OF THE INVENTION

Growers and packers in the apple industry in the Pacific Northwest have standardized on wooden agricultural containers or bins since about 1957. In the orchard, apple pickers place fleshly picked apples in the bins. The bins are taken to the packing house where they are sometimes emptied and the contents go through the regular packing process. Other times, the apples are sorted for size and grade and then the bins are refilled and placed in controlled atmosphere storage.

The standard wooden bin has interior dimensions of 47" wide, 47" long and 28 ½ inches in height. The wooden bins are fastened together with glue, nails, rivets and metal brackets.

Wooden bins suffer from certain disadvantages, such as:

a) Wood construction is subject to cracking and warpage.

b) A single bin may absorb 12 pounds of water during the first three months of controlled atmosphere storage. This moisture comes from the fruit and its loss promotes fruit shrivel.

c) Wood construction does not permit the recommended 8% to 11% free air space on the sides and bottom. This results in slower cooling of the bin contents, and increases difficulty in maintaining low temperatures during controlled atmosphere storage.

d) Wood promotes contamination problems by absorbing chemicals used in orchard and packing house operations.

e) Wood bins are often difficult and time consuming to repair.

f) Most wooden bins lack a bin interlocking feature that would promote stability when the bins are stacked one on another.

g) Wooden bins are not recyclable.

h) Dry wooden bins create fire hazards in bin storage areas.

The advantages of a plastic bin are:

a) Plastic does not absorb moisture which assists in the control of humidity during storage and enhances fruit quality.

b) With at least 10% free air space in the sides and bottom, the plastic bin allows faster cooling in storage, and assists in maintaining uniform low temperatures in the storage building.

c) Smooth interior wall and floor surfaces permit easy cleaning and reduce the potential for contamination caused by decay organisms which often are present in wood bins.

d) A molded interlocking feature permits safer storage and transport of vertically stacked bins.

e) The plastic can be recycled into new bins.

All of the above disadvantages of wooden bins and advantages of plastic bins are set forth in 'STUDIES ON APPLE BINS' by Dr. Alan F. Hauff, published by the Washington State Horticultural Association.

BRIEF DESCRIPTION OF THE INVENTION

This invention comprises a plastic agricultural container or fruit bin of rectangular shape, having four sides and a bottom. In plan view, the corners are triangular in shape for added strength. The upper edges of the sides are bowed inward slightly, and the bottom is formed as a shallow dome with the peak upward. When the bin is fully loaded with fruit, the pressure of the load causes the sides and bottom to become planar, so that adjoining sides are perpendicular to each other and the bottom is flat. The sides and bottom are formed with ribs on the outside. On two opposite sides, the lower edges of the sides are continuous for the width of the corner triangle, forming solid support for the bin. These bottom portions extend below the bottom of the bin a sufficient distance to allow for the insertion of the forks of a fork lift truck. The top edge of each of the four walls, except for the triangular corner areas, has an undercut lip for easy handling of the bin. As originally molded, the bottom of each corner is open, but a cap having ribbed projecting walls is inserted into the opening and pressed into place. At each upper corner there is a projection, triangular in cross-section. The lower caps have an indentation, triangular in cross-section, into which the upper projections fit when the bins are stacked one on another. This provides stacking stability, which is not present in most of the wooden bins now in use.

In the preferred embodiment, at each of the lower corners of the container, a rectangular opening extends upward as far as the bottom element of the container. The opening becomes partially closed off by a triangular shelf whose apex is at the inner corner, and whose other apexes are at the corners at the sides of the bin. There is thus a triangular opening formed by the outer sides of the corner and by the shelf which extends across the two outer corners. The triangular opening extends from the level of the bottom of the container to the top of the corner section. Vertical ribs are formed along the inside of the triangular opening for its full length. A bottom closure cap has a triangular strut extending upward for almost the full height of the container. Several ribs extend upward from the bottom closure cap to only the distance to the triangular shelf. The triangular strut has ribs which fit in between the ribs of the triangular opening. There is a rectangular opening in the bottom closure cap for insertion of an anti-skid rubber bumper. There is a triangular indentation in the bottom closure cap to match the projection from the bin on which this bin is stacked. The bottom closure cap, the triangular strut and the upward extending ribs are made of a harder and stiffer material than the container itself. This additional hardness and stiffness is achieved by adding calcium carbonate to the plastic mix.

In a different embodiment, the strut is a molded or extruded cylindrical tube, having ribs on the inside. The triangular passageway is provided with ribs which extend inwardly to support the cylindrical and strut. The strut is fully inserted from the bottom, and is spin-welded to the inside of the top of the container. The bottom cap may have a cylindrical receptacle into which the strut is inserted, or may have a molded fitting which is placed against the bottom of the strut. The strut may be made of plastic, wood or metal. In this embodiment, there is a conical projection extending upwardly from the top of the container, instead of a triangular projection. The bottom cap has a conical indentation which matches the upper conical projection.

In one of the ribbed spaces immediately below the upper edge of the container, in a place which can be seen by a fork lift driver, there are projections which are designed to hold a packing ticket. Alongside these projections there is a cylindrical projection into which is inserted a radio frequency transponder which has been set with a serial number for the container. There is a cap over the cylindrical projection to hold the transponder. When a hand-held device is aimed at the transponder and activated, the transponder radios the serial number to the hand-held device, and the number is reproduced on the hand-held device.

In the flat area between the ribs on the side walls, openings are provided for air movement, which aids in rapid cooling of the fruit. The openings may be longitudinal slots, or may be round holes. Similar openings are provided in the bottom to aid in air circulation through the fruit load.

In the preferred embodiment of the bin, gas injection tubes are molded into the rib area on the lower side of the bottom, and may continue up the side walls.

BRIEF DESCRIPTION OF THE DRAWINGS

FIG. 3 is a front elevation view of the bin.

FIG. 4 is a side elevation view of the bin.

FIG. 7 is a sectional view taken at line 7—7 of FIG. 5.

FIG. 8 is a sectional view taken line 8—8 of FIG. 3.

FIG. 13 is a sectional view taken at line 13—13 of FIG. 3.

FIG. 14 is a sectional view taken at line 14—14 of FIG. 5.

FIG. 16 illustrates the packing ticket holder, FIG. 17 is a view of the bottom of the preferred embodiment showing gas injection tube locations.

FIG. 18 is a view of the front of the preferred embodiment showing a gas injection tube on a front wall of the bin.

FIG. 19 is a plan view of the preferred embodiment of the bin showing the location of gas injection tubes on the vertical walls.

FIG. 20 is a sectional plan view of the preferred embodiment showing gas injection tube locations on the vertical walls.

FIG. 23 is a perspective view of a portion of the agricultural container taken from below.

FIG. 24 shows a cylindrical strut and closure cap.

FIG. 25 shows a different cylindrical strut from FIG. 24.

FIG. 26 is a perspective view of a portion of the agricultural container taken from above.

FIG. 27 shows a view of the cylindrical strut of FIG. 24 taken from above and broken away.

FIG. 28 shows a view of the cylindrical strut of FIG. 25 taken from above and broken away.

DETAILED DESCRIPTION OF THE INVENTION

Figure 1:
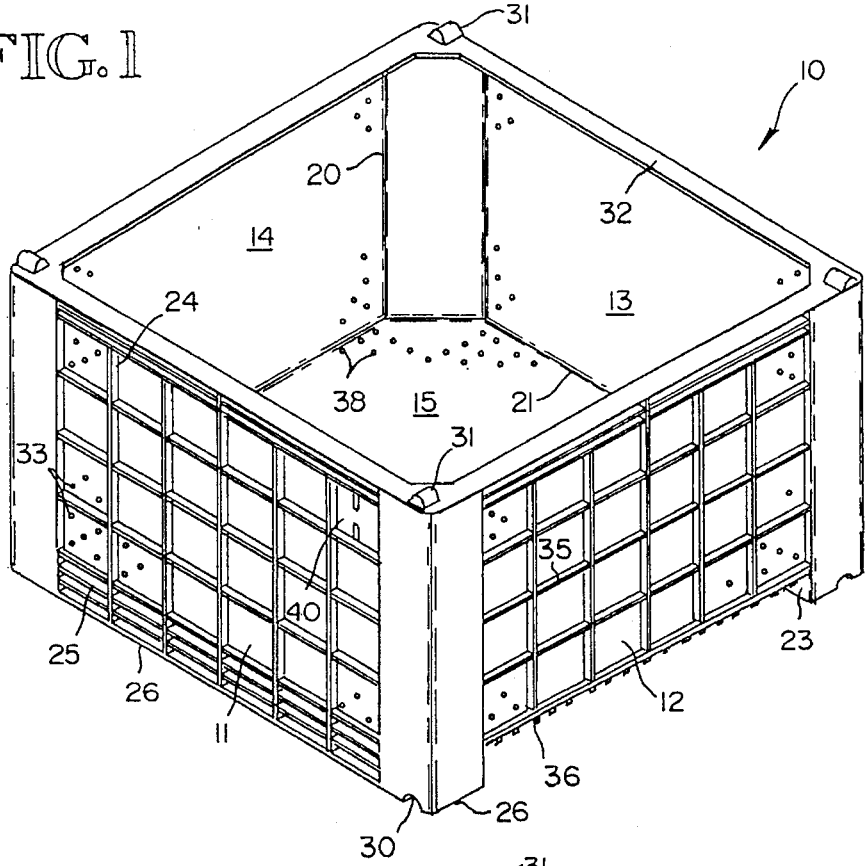
FIG. 1 is a perspective view of the bin as viewed from above.
Figure 2:
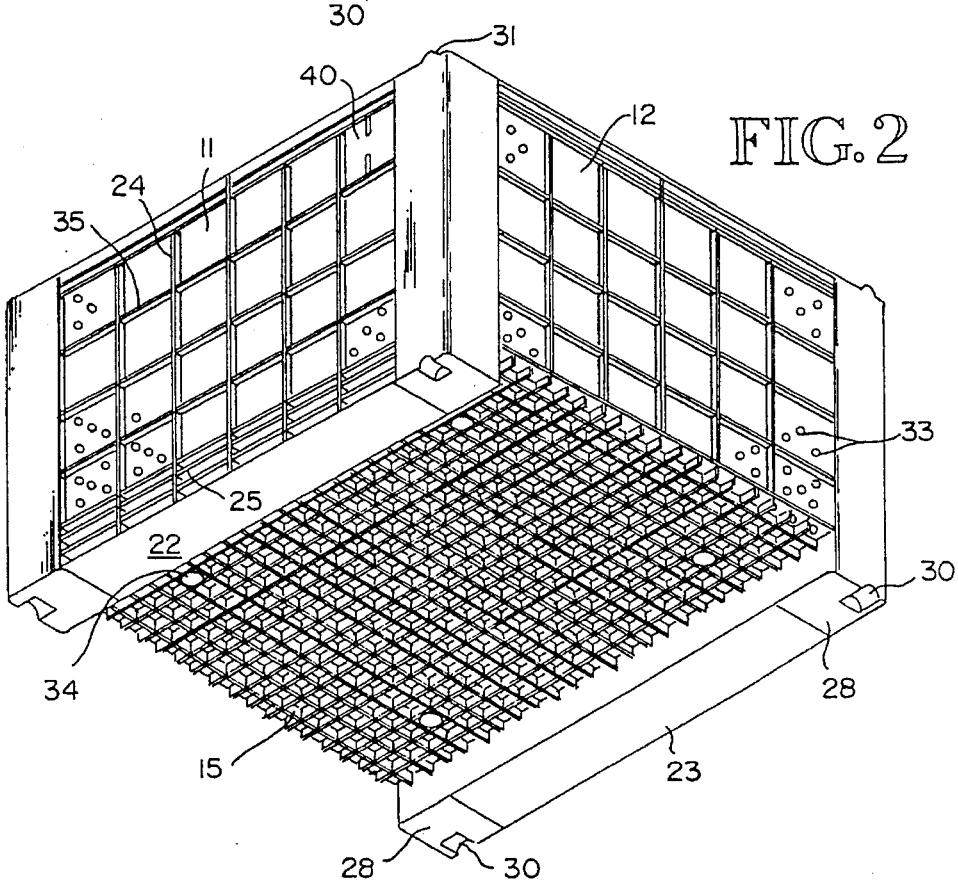
FIG. 2 is a perspective view of the bin as viewed from below.

The fruit bin of this invention may be made of either high density polyethylene or rigid polyvinyl chloride (PVC). In either case, an ultra-violet inhibitor would be added to the mix before molding. The bin may be produced in various colors, for example, white, gray or green.

The fruit bin is indicated generally as 10. There is a front wall 11, a side wall 12, a rear wall 13, a side wall 14 and a bottom 15. The interior surfaces of walls 11, 12, 13 and 14 and of the bottom 15 are smooth. The exterior surfaces of walls 11, 12, 13 and 14 are molded with a rectangular rib pattern, the ribs being perpendicular to each other, each of the vertical ribs 24 and each of the horizontal ribs 35 being spaced several inches apart. The exterior of bottom 15 is molded with a rectangular rib pattern, the ribs 36 being perpendicular to each other and being spaced more closely than the ribs on the walls.

Walls 11, 12, 13 and 14 are joined by triangular elements. Triangular element 16 joins walls 11 and 12. Triangular element 17 joins walls 12 and 13. Triangular element 18 joins walls 13 and 14. Triangular element 19 joins walls 14 and 11. The joint between each triangular element and each wall is rounded, as shown by 20 in FIG. 1. The joint between each wall and each triangular element and bottom 15 is rounded, as shown by 21 in FIG. 1.

Figure 6:
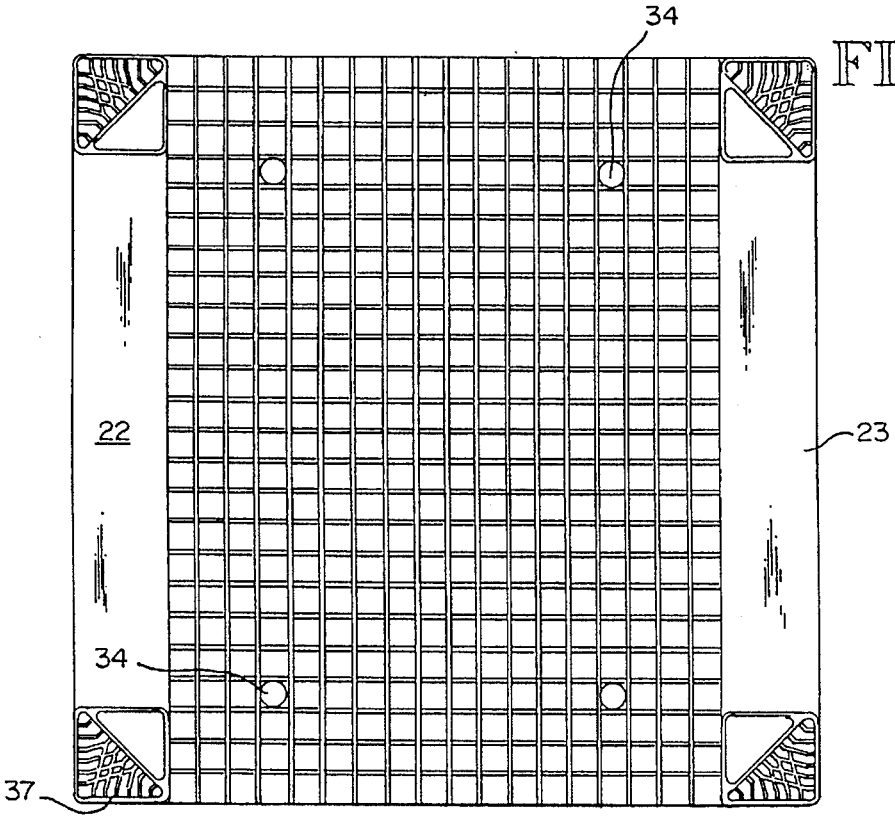
FIG. 6 is a view of the bottom of the bin.
Figure 10:
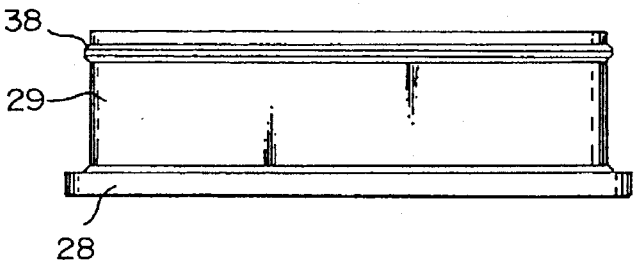
FIG. 10 is an elevation view of a closure cap.
Figure 11:
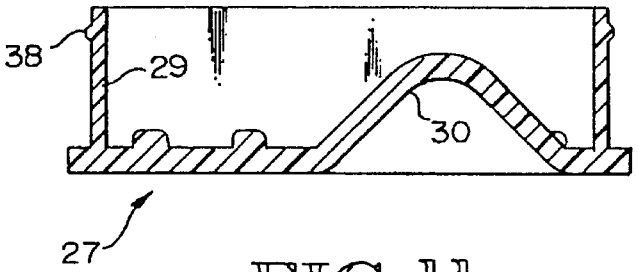
FIG. 11 is a sectional view of a closure cap taken at line 11—11 of FIG. 9.
Figure 9:
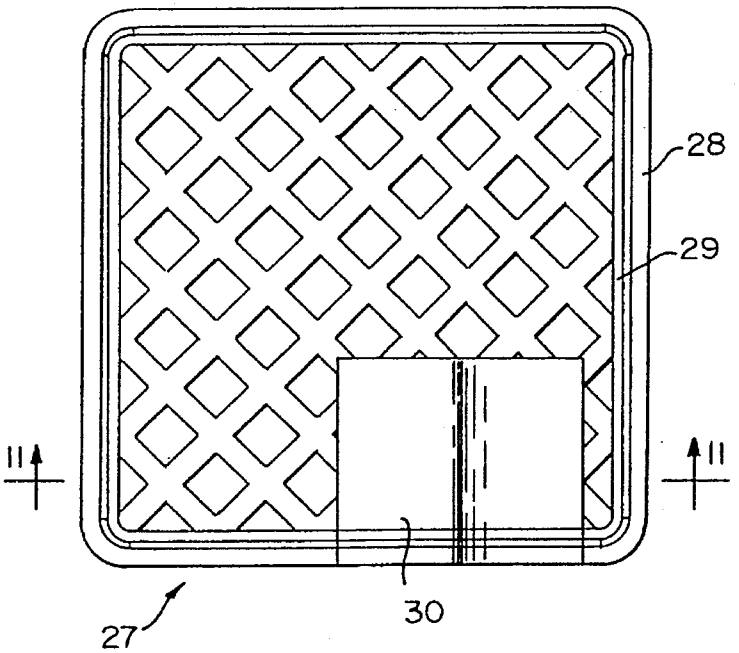
FIG. 9 is a plan view of a closure cap for a corner element.
Figure 12:
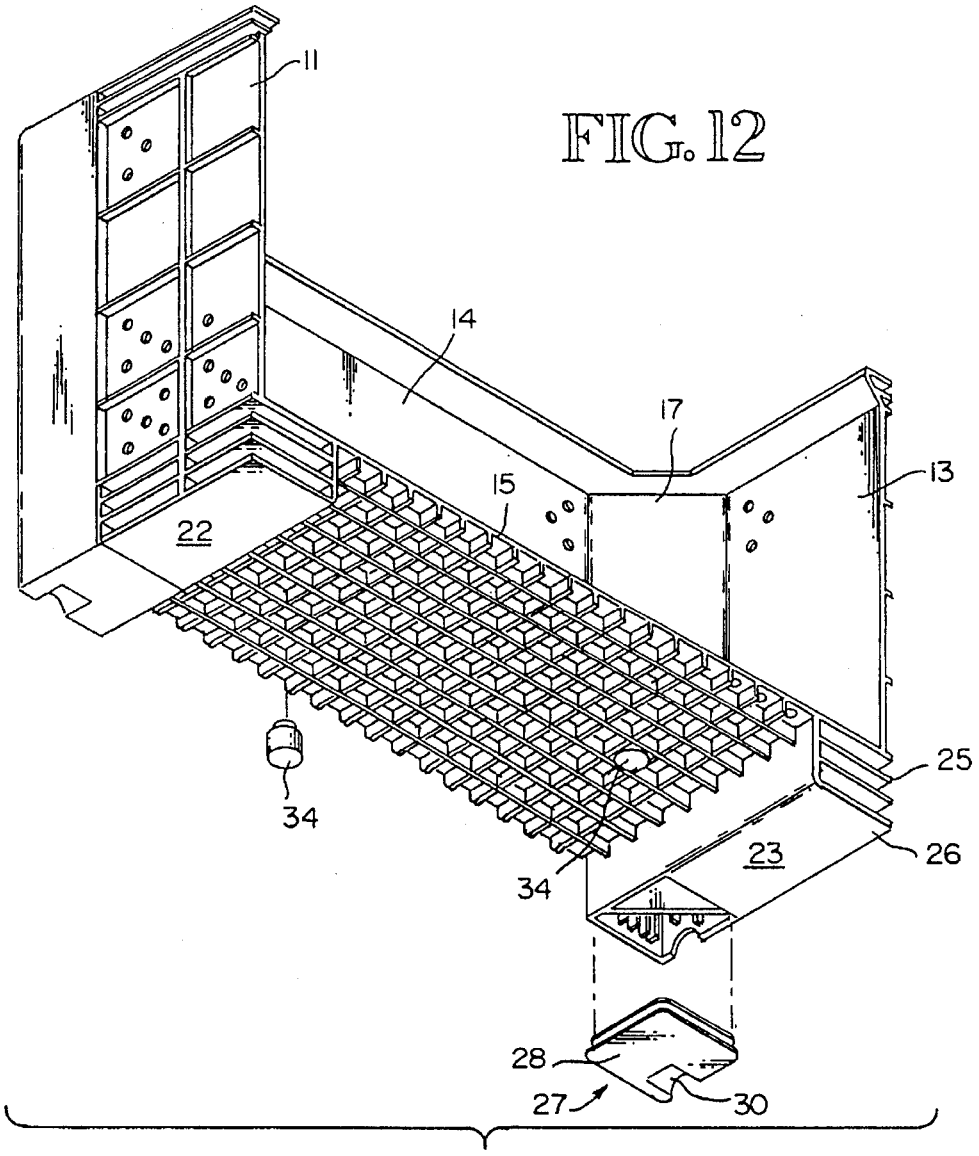
FIG. 12 is a sectional perspective view of the bin showing a closure cap and showing rubber bumpers inserted into the bottom grid.

Each triangular element 16, 17, 18 and 19 has longitudinal ribs 37 molded into the interior of the element, as can be seen in FIG. 6. The ribs 37 do not extend all the way to the bottom of the triangular elements. The ribs 37 are shortened to allow a cap (described below) to be pressed into place.

Support for the bin is formed under front wall 11 and back wall 13. A box shaped element 22 extends the length of front wall 11. The height of the box shape is sufficiently below bottom 15 to allow for insertion of the forks of a fork lift truck, with room to spare. The width of the box shape is approximately that of one of the perpendicular legs of each triangular element. A similar box shaped element 23 underlies back wall 13. It will be noted that the box shaped elements 22 and 23 are not completely enclosed. The vertical ribs 24 on front wall 11 and back wall 13 are continued downward. Horizontal ribs 25 are molded, with the lowermost rib forming the bottom 26 of each box-shaped element.

Figure 21:
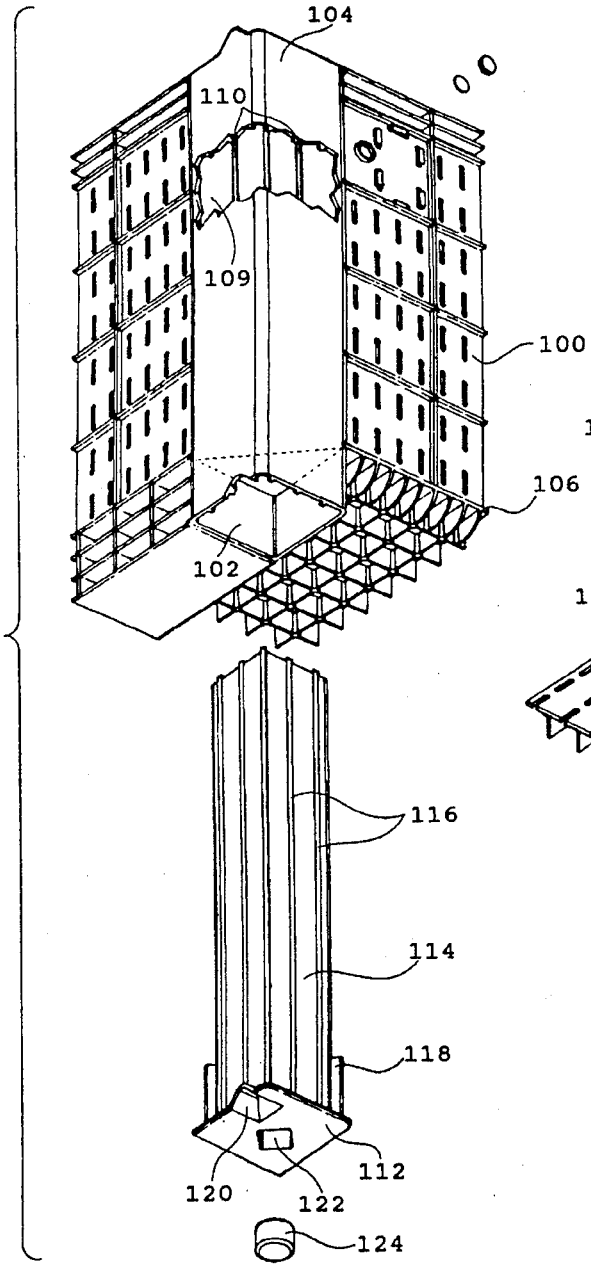
FIG. 21 is a perspective view of a portion of the preferred embodiment of the agricultural container, taken from below, and showing a triangular strut ready of insertion.
Figure 22:
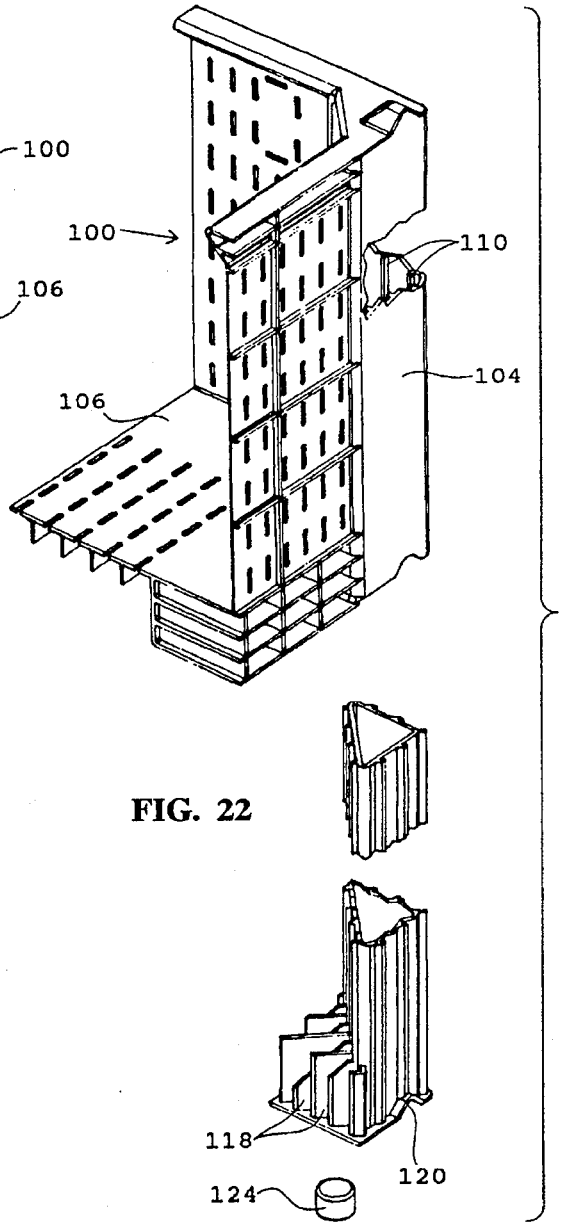
FIG. 22 is a perspective view of a portion of the preferred embodiment of the agricultural container, taken from above, and showing a broken view of a triangular strut ready for insertion.
Figure 29:
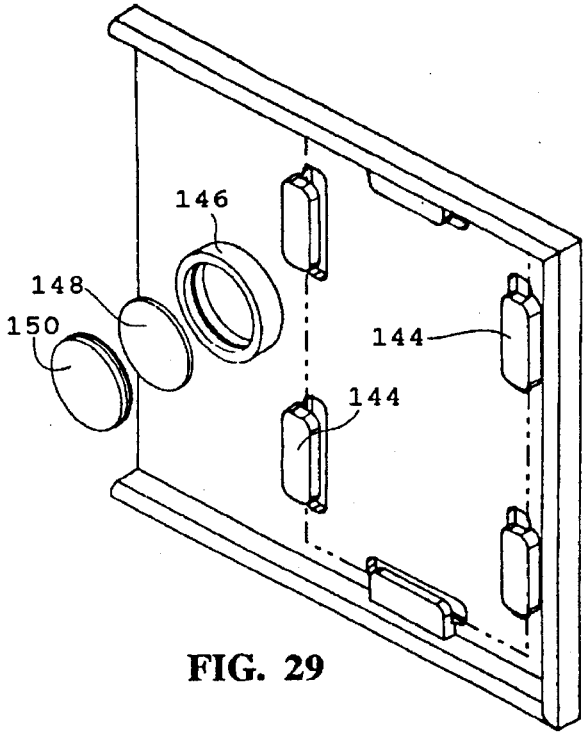
FIG. 29 shows the portion of the container on which the identification card and the radio frequency transponder are mounted.
Figure 30:
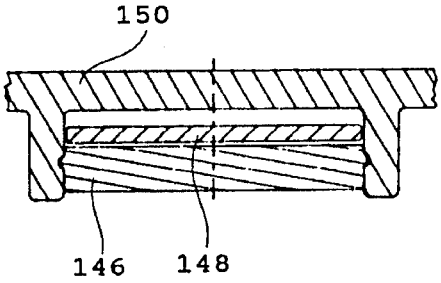
FIG. 30 is a cross-section showing the radio frequency transponder and the cap which holder the transponder in place.
Figure 31:
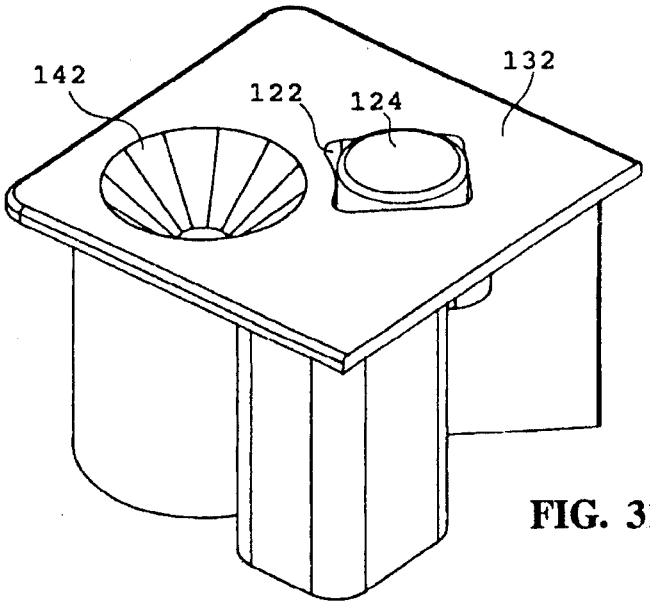
FIG. 31 shows the closure cap of FIGS. 24, 25, 27 and 28 with an elastomer anti-skid bumper in place.
Figure 32:
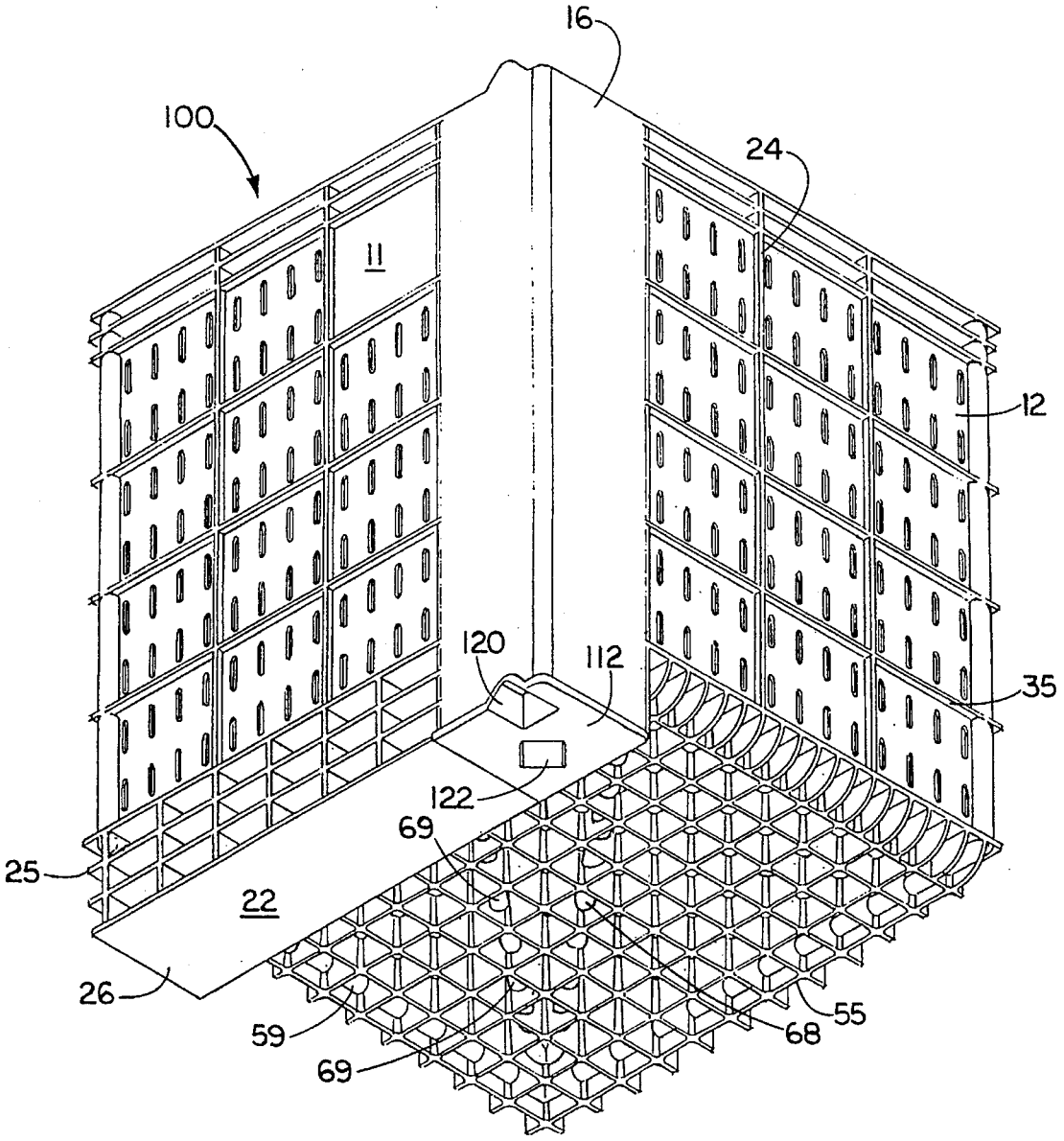
FIG. 32 is a perspective view of a portion of the preferred embodiment of the agricultural container, taken from below, and showing the triangular strut inserted as well as the gas injection tubes.

Referring to FIGS. 21 and 22, there is a rectangular recess 102 extending upward from the bottom of each corner 104. The recess 102 extends from the bottom of the corner section upward to the level of the bottom 106 of the container 100.

The recess 102 is partially closed at that level by a triangular shelf 108 which is shown in phantom lines in FIG. 21. A triangular passageway 109 is formed at that level, the passageway 109 extending to the top of the container 100. The passageway 109 has stiffening ribs 110 formed on the sidewalls as can be seen in FIGS. 21 and 22. Extending upward from the bottom closure cap 112 is a triangular strut 114 which itself has stiffening ribs 116 which fit between the ribs 110 in the passageway 109. The fit between the strut 114 and the passageway 109 is a force fit. A series of short plates 118 extend upwardly from the inside of the closure cap 112, so that when the closure cap 112 is inserted, the upper edge of the short plates 118 abuts the triangular shelf 108. The bottom closure cap 112 has a triangular recess 120 which fits over the triangular projection on the next lower container. In addition, a rectangular recess 122 is formed in the bottom of the closure cap 112 for insertion of an elastomer anti-skid bumper 124. In forming the bottom closure cap 112 and strut 114, calcium carbonate is added to the plastic mix so that the strut 114 and cap 112 are stiffer and harder than the plastic from which the container is made.

As can be seen in FIGS. 23–28, a cylindrical strut may be used. The strut may be of molded or extruded plastic. The passageway 126 has ribs 128 which extend inwardly to touch and support the cylindrical strut 130. The cylindrical strut 130, without the cap 132, is inserted all the way into the passageway 126 and is spin-welded to the underside of the top of the container 133. The cap 132, as indicated in FIGS. 24 and 27, may have a cylindrical receptacle 134 which is placed over the strut 130 with a force fit. The cap 132, as indicated in FIGS. 25 and 28, may have a cylindrical support 136 which presses against the bottom of the cylindrical strut 138. The bottom cap, in this case also is a force fit.

The cylindrical strut may also be made of wood, cardboard or metal, in which case, of course, it is not spin-welded to the top of the container.

In the case of the cylindrical struts, it will be noted that the projection at the top of the container is a cone 140, and the bottom cap has a matching indentation 142.

In FIGS. 21 and 23, packing ticket holder projections 144 are formed in a ribbed rectangle just under the top lip. Alongside the ticket projections is a cylindrical container 146 for the radio frequency transponder 148, and a cap 150 is shown which is placed over the container 146 to hold the transponder 148 therein.

Along the upper edge of each wall 11, 12, 13 and 14 is an inward-extending lip 32 which terminates where the lip 32 meets a triangular corner section. The purposes of lip 32 are to strengthen the walls, provide more stable stacking and to use as a handhold when moving empty bins.

Figure 5:
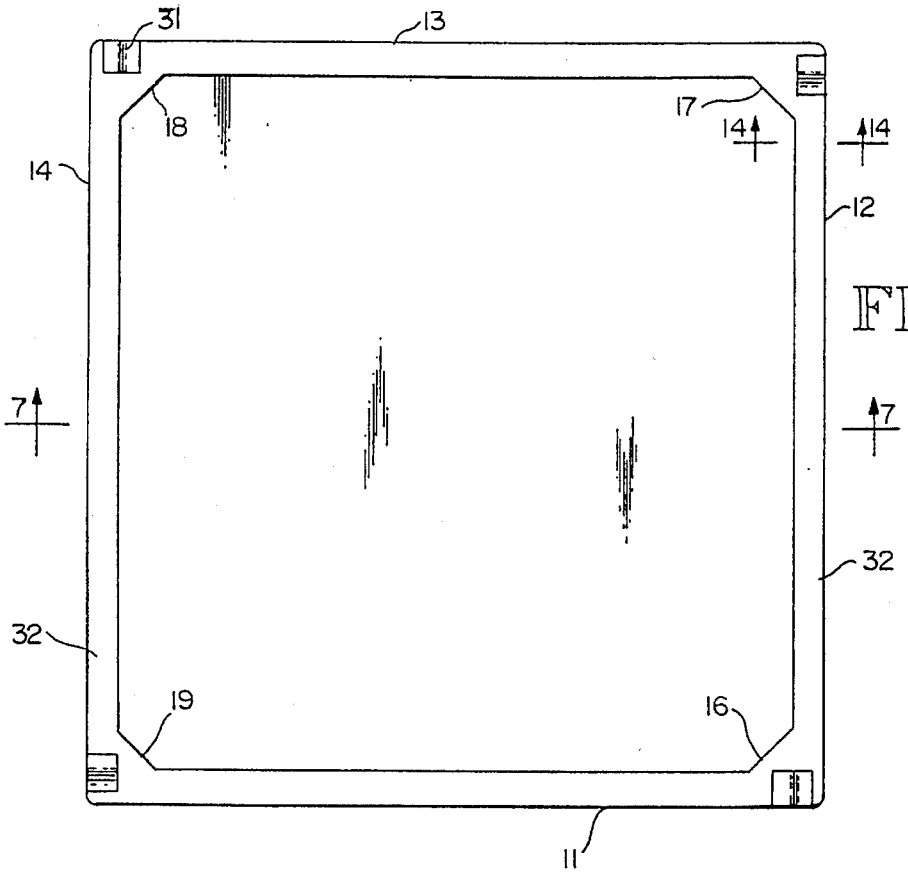
FIG. 5 is a plan view of the bin.

It will be noted, particularly in FIG. 5, that the upper edges of the walls 11, 12, 13 and 14 are bowed inward slightly.

It will also be noted in FIG. 7 that the bottom forms a very shallow dome oriented inwardly. The purpose of the bowing and the dome is to allow the weight of the fruit to move the walls outward, and the bottom downward, so that the walls and bottom become planar. This prevents crushing the fruit when the loaded bins are lifted and stacked.

In the planar portions between the ribs on walls 11, 12, 13 and 14 there are openings 33 to allow the circulation of air through the bins to cool the fruit. Openings 38 are also provided in the bottom of the bin to assist in cooling. This is particularly important when loaded bins are placed in storage. If the fruit is cooled rapidly, the fruit will stay in better condition. In addition, good air circulation through the bins assists in maintaining the proper temperature during storage.

Cylindrical rubber bumpers 34 are placed into some of the square rib spaces on bottom 15. The bumpers extend about ⅛ inch below the ribs on the lower surface of bottom 15. The purpose of bumpers 34 is to engage the upper surface of the steel forks of fork lift trucks. If bumpers 34 were not used, there might be a tendency for the plastic bin to slide on the steel surface of the forks.

Figure 15A:
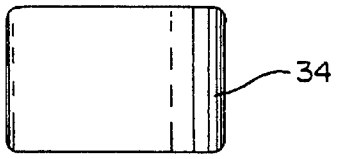
FIG. 15 illustrates a rubber bumper inserted into the rib section on the lower side of the bottom element.
Figure 15B:
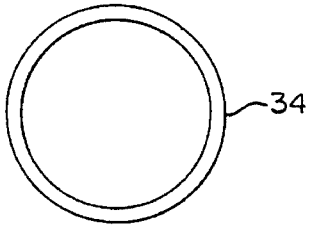

FIG. 15 illustrates a clear flexible, plastic packing ticket holder 40 which is inserted into a rib space on the side of the bin. Holder 40 has finger indentations 41 and flanges 42 which engage vertical elements of the bin.

The preferred embodiment of the agricultural container or fruit bin utilizes gas injection tubes which assist in insuring full flow of the plastic in the mold. The bin of the preferred embodiment has the four vertical walls, the bottom element, the rib patter, the air circulation openings and the slightly bowed-in sides and the slightly domed bottom. FIG. 17 which is a view of the bottom of the bin best illustrates the orientation of the gas injection tubes. The tubes are formed within the grid pattern on the lower side of bottom element 50. Tube 51 serves side 152, and tube 53 serves side 54. Tube 55 serves side 56, and tube 57 serves side 58. Tubes 59 and 60 serve corner element 61. Tubes 62 and 63 serve corner element 64. Tubes 65 and 66 serve corner element 67. Tubes 68 and 69 serve corner element 70.

In FIG. 18, vertical gas injection tube 72 is a continuation of tube 53. In the plan view shown in FIG. 19, tube 71 is a continuation of tube 55. Tube 73 is a continuation of tube 51, and tube 74 is a continuation of tube 52.

While this invention is susceptible of embodiment in different forms, the drawings and the specification illustrate the preferred embodiment and a second embodiment of the invention, with the understanding that the present disclosure is to be considered an exemplification of the principles of the invention, and the disclosure is not intended to limit the invention to the particular embodiments described.

We claim:

1. A plastic fruit bin comprising:

four vertical walls forming, in plan view, a rectangular shape;

a bottom element joined to the four vertical walls;

two support elements, each extending along and attached to the bottom of each of two opposite walls and partly supporting and extending below the bottom element;

the vertical walls being joined to each other at their ends by a triangular shaped column, each of said columns forming a corner of the bin, and said columns being stiffened internally with longitudinal ribs;

a rectangular recess at the bottom of each corner, the depth of the recess rising to the level of the bottom element of the bin;

said recess being partially closed by a triangular shelf having its apex at the inner corner of the rectangle, and being defined by the two corners of the rectangle adjacent to the inner corner, with the edge of the shelf which extends between the two corners of the rectangle defining the lower end of a triangular passageway;

a bottom closure cap having a triangular strut extending upwardly therefrom for almost the full height of the bin; and said closure cap having vertical plates which contact the triangular shelf when the triangular strut is inserted into the triangular passageway and the bottom closure cap fully closes the rectangular recess.

2. The bin of claim 1 wherein the inside of the bin is smooth and the joints between the vertical walls, the triangular columns and the bottom element are rounded.

3. The bin of claim 1 wherein the exterior of the vertical walls and the lower side of the bottom element have a rectangular rib pattern formed thereon.

4. The bin of claim 3 wherein the planar spaces within the rib patterns of the vertical walls and the bottom element are provided with openings for atmospheric circulation.

5. The bin of claim 3 wherein a plurality of rubber plugs is inserted into spaces in the rib pattern on the lower side of the bottom element.

6. The bin of claim 1 wherein the upper portions of the vertical walls are bowed slightly inward, and the center of the bottom element is bowed slightly upward.

7. The bin of claim 1 wherein recesses are formed at the lower end of each closure cap, and matching projections are formed at the upper end of each column.

8. A plastic fruit bin comprising:

four vertical walls forming, in plan view, a rectangular shape;

a bottom element joined to the four vertical walls;

two support elements, each extending along and attached to the bottom of each of two opposite vertical walls and partly supporting and extending below the bottom element; and an array of gas injection tubes disposed on the lower side of the bottom element and extending up the center of each of the four vertical walls the vertical walls are joined to each other at their sides by a triangular shaped column, each of said columns forming a corner of the bin, and said columns being stiffened internally with longitudinal ribs;

a rectangular recess at the bottom of each corner, the depth of the recess rising to the level of the bottom element of the bin;

said recess being partially closed by a triangular shelf having its apex at the inner corner of the rectangle, and being defined by two corners of the rectangle adjacent to the inner corner, with the edge of the shelf which extends between the two corners of the rectangle defining the lower end of a triangular passageway;

a bottom closure cap having a triangular strut extending upwardly therefrom for almost the full height of the bin; and said closure cap having vertical plates which contact the triangular shelf when the triangular shelf is inserted into the triangular passageway and the bottom closure cap fully closes the rectangular recess.

9. The bin of claim 8 wherein the inside of the bin is smooth and the joints between the walls, the triangular columns and the bottom element are rounded.

10. The bin of claim 8 wherein the exterior of the vertical walls and the lower side of the bottom element have a rectangular rib pattern formed thereon.

11. The bin of claim 9 wherein the planar spaces within the rib patterns of the vertical walls and the bottom element are provided with openings for atmospheric circulation.

12. The bin of claim 10 wherein a plurality of rubber plugs is inserted into spaces in the rib pattern on the lower side of the bottom element.

13. The bin of claim 8 wherein the upper portions of the vertical walls are bowed slightly inward, and the center of the bottom element is bowed slightly upward.

14. The bin of claim 8 wherein recesses are formed at the lower end of each closure cap, and matching projections are formed at the upper end of each column.

* * * * *

UNITED STATES PATENT AND TRADEMARK OFFICE

CERTIFICATE OF CORRECTION

PATENT NO. : 5,460,292

DATED : October 24, 1995

INVENTOR(S) : Don Holman and Larry Kraft

It is certified that error appears in the above-identified patent and that said Letters Patent is hereby corrected as shown below:

On the cover page:

Beneath the phrase "United States Patent," change "Holman" to –Holman et al.–; and In the "Inventor" section, after the word "98815" insert –; Larry Kraft, 615 South 23rd Avenue, Yakima, Wash. 98902–.

Signed and Sealed this

Second Day of June, 1998

*Attest:*

Bruce Lehman

BRUCE LEHMAN

*Attesting Officer*

*Commissioner of Patents and Trademarks*